US010526791B2

(12) United States Patent
Loyd

(10) Patent No.: US 10,526,791 B2
(45) Date of Patent: Jan. 7, 2020

(54) CURTAIN WALL SYSTEM AND METHOD

(71) Applicant: Stephen N. Loyd, Dallas, TX (US)

(72) Inventor: Stephen N. Loyd, Dallas, TX (US)

(73) Assignee: Stephen N. Loyd Irrevocable Family Trust, Dallas, TX (US)

( * ) Notice: Subject to any disclaimer, the term of this patent is extended or adjusted under 35 U.S.C. 154(b) by 169 days.

(21) Appl. No.: 15/435,355

(22) Filed: Feb. 17, 2017

(65) Prior Publication Data

US 2017/0159299 A1 Jun. 8, 2017

Related U.S. Application Data

(62) Division of application No. 14/290,069, filed on May 29, 2014, now Pat. No. 9,631,373.

(51) Int. Cl.
*E04F 13/08* (2006.01)
*E04B 2/90* (2006.01)
(Continued)

(52) U.S. Cl.
CPC ..... *E04F 13/25* (2013.01); *E04B 1/40* (2013.01); *E04B 2/90* (2013.01); *E04F 13/0826* (2013.01);
(Continued)

(58) Field of Classification Search
CPC ..... E04B 2/88; E04B 2/90; E04B 2/94; E04B 2/96; E04B 2/967; E04F 13/14; E04F 13/0833; E04F 13/0835; E04F 13/0837; E04F 13/0839; E04F 13/0841; E04F 13/0842; E04F 13/0844; E04F 13/0846;
(Continued)

(56) References Cited

U.S. PATENT DOCUMENTS 2,245,785 A 6/1941 Jentzer, Jr.
3,343,423 A 9/1967 Mayfield
(Continued)

OTHER PUBLICATIONS

Mexican Patent Office; OA and English Translation Re: Examination Results; Application PA/a/2006/002573, Ref. 205/025561; U.S. Appl. No. 11/074,086, dated Oct. 23, 2009.
(Continued)

*Primary Examiner* — Jessica L Laux
(74) *Attorney, Agent, or Firm* — Slater Matsil, LLP

(57) ABSTRACT

In certain embodiments, a system includes a curtain wall member and a first curtain wall member mounting apparatus coupled to a first end of the curtain wall member. The first curtain wall member mounting apparatus includes a mounting plate and an arm having one or more projections. The first curtain wall member mounting apparatus engages with a first curtain wall member supporting channel having a vertically-disposed member and a horizontally-disposed supporting member having a receiving-and-retaining member extending from an end opposite the vertically-disposed member. The receiving-and-retaining member engages with a channel adjacent to one or more projections of the first curtain wall member mounting apparatus. The first curtain wall member mounting apparatus is adapted to be rotated into position such that a connection mechanism at a second end of the curtain wall member engages with a second curtain wall member supporting channel to retain the curtain wall member in position.

20 Claims, 9 Drawing Sheets

(51) Int. Cl.
*E04F 13/25* (2006.01)
*E06B 3/54* (2006.01)
*E04B 1/41* (2006.01)

(52) U.S. Cl.
CPC ..... *E06B 3/5436* (2013.01); *E06B 3/5445* (2013.01); *E06B 3/5427* (2013.01); *Y10T 16/373* (2015.01)

(58) Field of Classification Search
CPC . E04F 13/0848; E04F 13/085; E04F 13/0853; E04F 13/0855; E04F 13/0801; E04F 13/0803; E04F 13/0805; E04F 13/0807; E04F 13/0808; E04F 13/081; E04F 13/0812; E04F 13/0814; E04F 13/0816; E04F 13/0817; E04F 13/0821; E04F 13/0823; E04F 13/0825; E04F 13/0826; E06B 3/5436; E06B 3/5445; E06B 3/54274; E04G 21/00
USPC ..... 52/747.1, 235
See application file for complete search history.

(56) References Cited

U.S. PATENT DOCUMENTS 3,640,043 A 2/1972 Querfeld et al.
3,786,605 A 1/1974 Winfrey
3,831,506 A 8/1974 Landheer
4,070,835 A * 1/1978 Reverend ..... E04F 13/0808 52/126.1
4,483,122 A 11/1984 Crandell
4,506,482 A 3/1985 Pracht et al.
4,625,481 A * 12/1986 Crandell ..... E04F 13/0889 52/235
5,265,396 A 11/1993 Amimoto
5,301,484 A * 4/1994 Jansson ..... E04F 13/145 52/122.1
5,313,760 A 5/1994 Tojo
5,473,851 A 12/1995 Northrup, Jr.
6,098,364 A 8/2000 Liu
6,170,214 B1 1/2001 Treister et al.
6,202,377 B1 3/2001 Krieger
6,792,727 B2 9/2004 Krieger
8,051,623 B2 11/2011 Loyd
8,336,264 B2 12/2012 Sato et al.
8,341,901 B2 1/2013 Loyd
2002/0005024 A1 1/2002 Hsueh
2002/0152693 A1 10/2002 Krogstad
2003/0150179 A1 8/2003 Moreno
2005/0246983 A1 11/2005 Loyd
2008/0216444 A1 * 9/2008 Loyd ..... E04F 13/0803 52/742.16
2012/0117901 A1 5/2012 Loyd
2012/0137609 A1 6/2012 Loyd

OTHER PUBLICATIONS

Canadian Intellectual Patent Office; OA Communication, Application 2,538,441, Ref. file No. 60622, dated Aug. 31, 2012.
Canadian Intellectual Patent Office; OA Communication, Application 2,538,441, Ref. file No. 60622, dated Jul. 16, 2013.
Canadian Intellectual Patent Office; OA Communication, Application 2,538,441, Ref. file No. 60622, dated Feb. 7, 2014.

* cited by examiner

FIGURES 4A-4C
FIGURE 4A
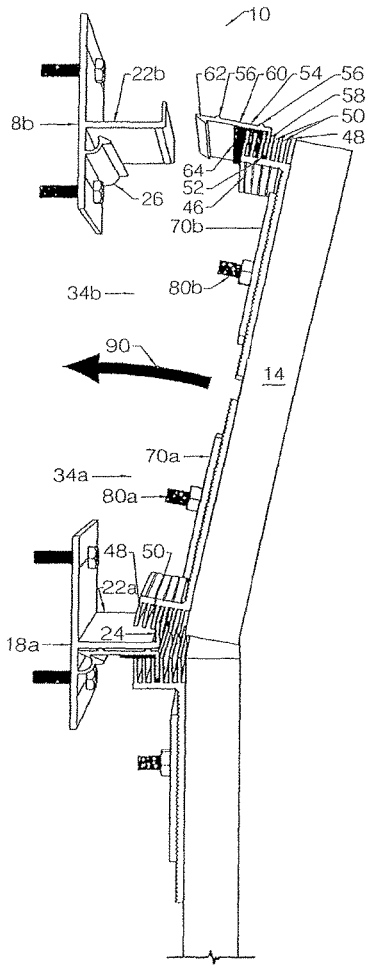
FIGURE 4B
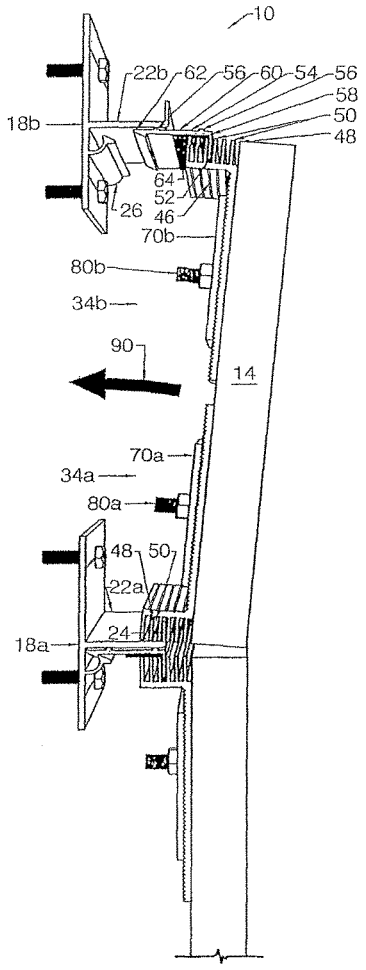
FIGURE 4C
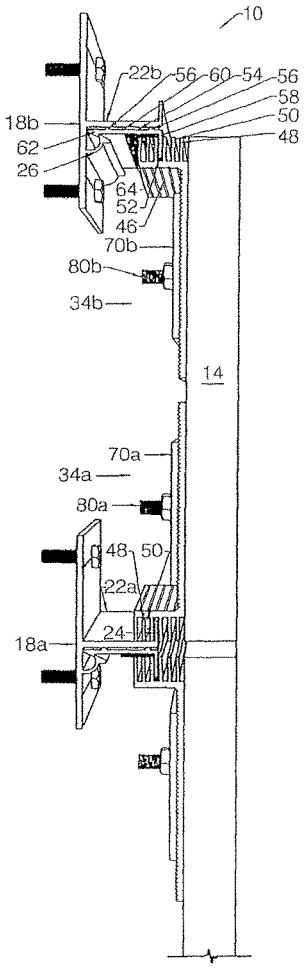

LOCK WASHER - ELEVATION VIEW

LOCK WASHER - SECTION VIEW

FORK - ELEVATION VIEW

FORK - SECTION VIEW

CURTAIN WALL SYSTEM AND METHOD

RELATED APPLICATION

This application claims the benefit, under 35 U.S.C. § 120, as a divisional of U.S. application Ser. No. 14/290,069, filed May 29, 2014 and entitled "Curtain Wall System and Method," the contents of which are herein incorporated by reference.

TECHNICAL FIELD

The present disclosure relates generally to systems and methods of construction, and more particularly to a curtain wall system and method.

BACKGROUND

In certain instances, it may be desirable to change the appearance of an exterior or interior wall. Furthermore, it may be desirable to provide an exterior covering for, or enhance the aesthetic appearance of, such a wall. The use of certain materials, such as those formed from ceramic, stone, or other suitable materials, may be desirable. In many instances, difficulties may be encountered in supporting and constructing the desired wall. Often, these difficulties may result in problems such as ill-fitting portions and an inefficient, time-consuming installation process that yields a less than desirable result.

SUMMARY

According to the present disclosure, disadvantages and problems associated with previous techniques for installing a curtain wall may be reduced or eliminated.

In certain embodiments, a curtain wall system is disclosed. The system includes a curtain wall member and a first curtain wall member mounting apparatus coupled to the curtain wall member at a first end of the curtain wall member. The first curtain wall member mounting apparatus includes a mounting plate and an arm having one or more projections. The first curtain wall member mounting apparatus is adapted to engage with a first curtain wall member supporting channel. The first curtain wall member supporting channel has a vertically-disposed member and a horizontally-disposed supporting member. The horizontally-disposed supporting member has a receiving-and-retaining member extending from an end opposite the vertically-disposed member. The receiving-and-retaining member is adapted to engage with a channel adjacent at least one of the one or more projections of the first curtain wall member mounting apparatus. The first curtain wall member mounting apparatus is adapted to be rotated into position such that a connection mechanism at a second end of the curtain wall member engages with a second curtain wall member supporting channel to retain the curtain wall member in position.

In certain embodiments, an apparatus is disclosed. The apparatus includes a mounting plate and an arm. The mounting plate has a first surface and a second serrated surface opposite the first surface. The arm has one or more projections and one or more channels adjacent to the one or more projections.

In certain embodiments, a method is disclosed. The method includes embedding a receiving-and-retaining member of a first curtain wall member supporting channel in a channel adjacent to one or more projections of a first curtain wall member mounting apparatus. The first curtain wall member mounting apparatus is coupled to a first end of a first curtain wall member. The first curtain wall member mounting apparatus includes a mounting plate and an arm having the one or more projections. The method also includes rotating the first curtain wall member inwardly toward a second curtain wall member supporting channel such that a connection mechanism at a second end of the first curtain wall member engages with the second curtain wall member supporting channel to retain the curtain wall member in position.

In certain embodiments, an apparatus is disclosed. The apparatus includes a first serrated surface and a second surface opposite the first. The first serrated surface is adapted to couple to a corresponding serrated surface of an apparatus. The first serrated surface and the second surface are adapted to extend along at least a portion of the length of the corresponding serrated surface of the apparatus to provide support. The apparatus also includes an aperture and a fastener for coupling the first serrated surface to the corresponding serrated surface of the apparatus.

Particular embodiments of the present disclosure may provide one or more technical advantages. For example, in certain embodiments, curtain wall members may be formed of thin materials, making it impossible or impracticable to create a kerf joint for use in installing the curtain wall members. Certain embodiments of the present disclosure may advantageously make it possible to use thin pieces of ceramic tile or other suitable materials in the formation of a curtain wall. In certain embodiments, it may be desirable to adjust the fit of a curtain wall member in a curtain wall system during the installation process, without having to use shims. In certain embodiments, the present disclosure may have a built-in shimming mechanism, allowing optimal placement of a curtain wall member within a curtain wall to be determined during installation of the curtain wall member. In certain embodiments, this may be accomplished by varying the position of curtain wall member mounting apparatuses relative to other components of the curtain wall system, eliminating the need for additional components such as shims. Furthermore, it may be desirable to have the ability to preassemble components of a curtain wall system in advance of installation. For example, in certain embodiments an installer of a curtain wall system according to the present disclosure may be able to affix one or more curtain wall member mounting apparatuses to a plurality of curtain wall members in advance of installing a curtain wall. Such an approach may allow the installation process to proceed more quickly and efficiently.

Certain embodiments of the present disclosure may provide some, all, or none of these advantages. Certain embodiments may provide one or more other technical advantages, one or more of which may be readily apparent to those skilled in the art from the figures, descriptions, and claims.

BRIEF DESCRIPTION OF THE DRAWINGS

To provide a more complete understanding of embodiments of the present disclosure and the features and advantages thereof, reference is made to the following description taken in conjunction with the accompanying drawings, in which:

FIGS. 4A through 4C illustrate the curtain wall installation process in accordance with certain embodiments of the present disclosure.

DESCRIPTION OF EXAMPLE EMBODIMENTS

In many instances, it may be desirable to construct a facade along an exterior wall of a building. A curtain wall may be particularly desirable in certain circumstances, in part because of the range of materials available for use in a curtain wall system, as well as the pleasing aesthetics of such a curtain wall system. Often, however, the materials chosen for implementation in a curtain wall system are thin, making installation a challenge. Further difficulties may also be encountered in fitting the materials into a curtain wall system to achieve a desired appearance, often requiring much time and the use of additional components, such as shims, to achieve the desired result. At least certain embodiments of the present disclosure address these and potentially other deficiencies of existing systems and methods of constructing curtain walls.

Figure 1:
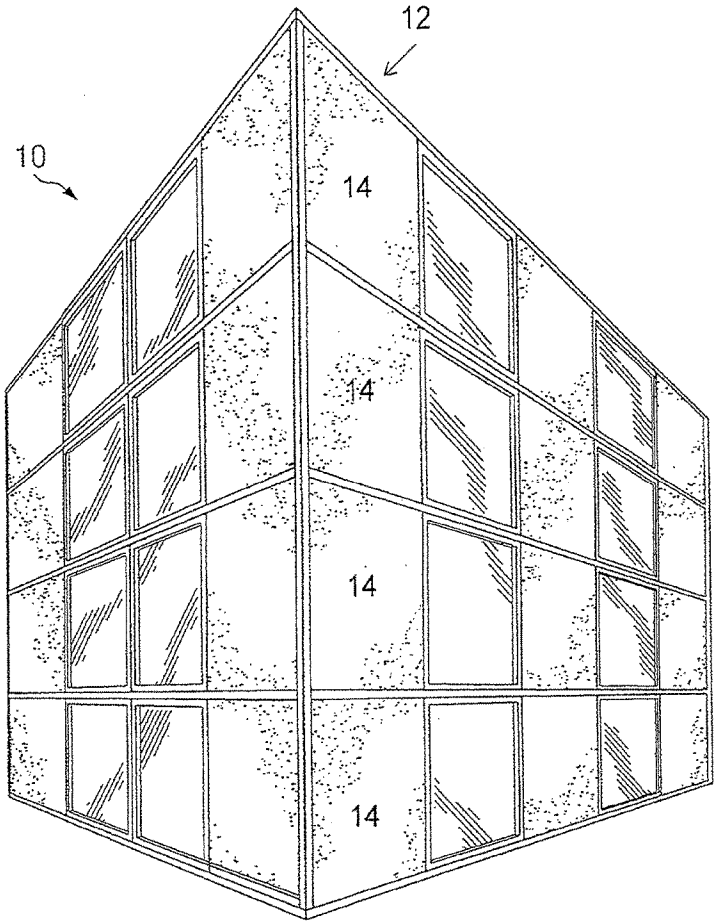
FIG. 1 illustrates an environmental view of an example of a curtain wall system installed in accordance with certain embodiments of the present disclosure.

FIG. 1 illustrates an environmental view of an example of a curtain wall system 10 installed in accordance with certain embodiments of the present disclosure. In certain embodiments, curtain wall system 10 includes one or more curtain walls 12 formed of one or more curtain wall members 14. Curtain wall members 14 may be composed of ceramic, stone, glass, aluminum, wood, composite graphite, or any other suitable material or combination of materials.

Figure 2:
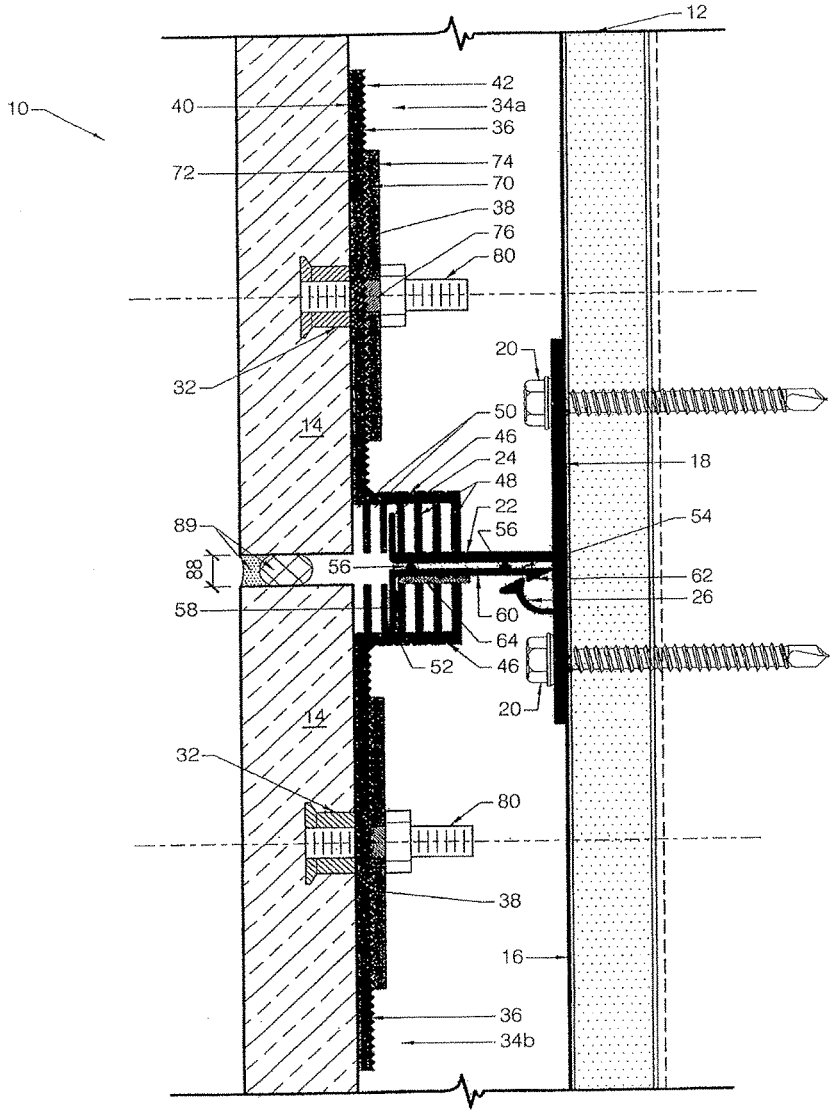
FIG. 2 illustrates a curtain wall system constructed in accordance with certain embodiments of the present disclosure.

FIG. 2 illustrates curtain wall system 10 constructed in accordance with an embodiment of the present disclosure. In particular, FIG. 2 illustrates an example system for mounting curtain wall members 14 to a wall 12. Wall 12 may include any suitable combination of plywood, steel or wood studs, concrete masonry units (CMOs), concrete, or any other suitable material. Other construction techniques may be used in the fabrication of wall 12 depending upon the requirements of particular applications of the present disclosure. In certain embodiments, wall 12 may be an exterior or interior wall of a building or other structure. In certain embodiments, wall 12 may be provided with a weather proof exterior layer 16, which may be fabricated using any suitable technique. As an example, weather proof exterior layer 16 may be self-sealing tape.

In certain embodiments, multiple curtain wall member supporting channels 18 are secured to the wall 12. Curtain wall member supporting channels 18 may be secured to wall 12 in any suitable manner, such as by suitable fasteners 20. The number of fasteners 20 for affixing curtain wall member supporting channels 18 to wall 12 may vary according to a particular application of curtain wall system 10. In certain embodiments, fasteners 20 may be placed at opposite ends of curtain wall supporting channel 18. Such an arrangement of fasteners 20 may provide strength for dead load requirements as well as resistance to both positive and negative wind load. In certain other embodiments, curtain wall member supporting channel 18 may be secured to wall 12 using a single fastener 20. The present disclosure contemplates the use of any suitable number of fasteners in affixing curtain wall member supporting channels 18 to wall 12. Curtain wall member supporting channel 18 may be formed from any suitable material or combination of materials. In certain embodiments, curtain wall member supporting channels 18 may be fabricated from aluminum. Other materials, however, may be used in the fabrication of curtain wall member supporting channels 18 depending upon the requirements of particular applications of curtain wall system 10.

Curtain wall member supporting channels 18 may be arranged in any suitable manner on wall 12. In certain embodiments, multiple curtain wall member supporting channels 18 may be positioned adjacent to one another to define a curtain wall support structure that extends substantially the entire width of wall 12. In certain embodiments, the length of a curtain wall member supporting channel 18 may extend substantially the entire width of a wall 12. The curtain wall member supporting channels 18 may be vertically displaced along wall 12, such that two rows of curtain wall member supporting channels affixed to wall 12 can support multiple curtain wall members 14. In certain other embodiments, curtain wall member supporting channels 18 may be positioned at spaced apart locations along the width of the wall 12 and vertically displaced curtain wall member supporting channels 18 may be substantially parallel to one another. The present disclosure contemplates the use of any suitable arrangement of curtain wall member supporting channels 18.

Each curtain wall member supporting channel 18 may include a supporting member 22, which may extend substantially perpendicularly outwardly from wall 12. In certain embodiments, a receiving-and-retaining member 24 may be located at and extend substantially perpendicularly upwardly from the distal end of supporting member 22. Receiving-and-retaining member 24 may be adapted to couple to a curtain wall member mounting apparatus, described below. In certain embodiments, curtain wall member supporting channel 18 is provided with a locking member 26. Although locking member 26 may be any suitable component, in certain embodiments locking member 26 may be referred to as a "tang." Curtain wall member supporting channel 18 may also include a stop positioned on the underside and at the back of curtain wall member supporting channel 18.

As described above, curtain wall members 14 may be composed of ceramic, stone, glass, aluminum, wood, composite graphite, or any other suitable material or combination of materials. Curtain wall members 14 may include an aperture 32. Aperture 32 may be formed in any suitable manner. For example, aperture 32 may be formed by boring a hole through curtain wall member 14. As another example, aperture 32 may be formed as part of a mold for creating curtain wall members 14.

In certain embodiments, aperture 32 may be adapted to accept a portion of a fastener 80. One or more curtain wall member mounting apparatuses 34 may be affixed to a surface of curtain wall member 14. As just one example, two curtain wall member mounting apparatuses 34 may be affixed to each curtain wall member 14, a first curtain wall member mounting apparatus 34 being affixed to curtain wall member 14 at a first end and a second curtain wall member mounting apparatus 34 being affixed to curtain wall member 14 at a second end. In certain embodiments, the first curtain wall member mounting apparatus 34 may be affixed to an upper end of curtain wall member 14, and a second curtain wall member mounting apparatus 34 may be affixed to a lower end of curtain wall member 14. FIG. 2 illustrates an embodiment in which a first curtain wall member mounting apparatus 34*a* is affixed to a lower end portion of the surface of a first curtain wall member 14*a*, and a second curtain wall member mounting apparatus 34*b* is affixed to an upper end portion of the surface of a second curtain wall member 14*b*.

Curtain wall member mounting apparatus 34 may include a mounting plate 36, an aperture 38, and an arm 46. Mounting plate 36 may be adapted to couple curtain wall member mounting apparatus 34 to curtain wall member 14. Mounting plate 36 may be affixed to curtain wall member 14 by any suitable mechanism.

Mounting plate 36 may have any suitable shape, according to particular needs. Additionally, mounting plate 36 may have any suitable contours, according to particular needs. Mounting plate 36 may have a first surface 40 and a second surface 42 opposite the first surface 40. First surface 40 may be adapted to rest substantially flush against curtain wall member 14, though the present disclosure contemplates there being any suitable intervening components or materials. In certain embodiments, second surface 42 may be serrated. Second serrated surface 42 may be adapted to couple to a portion of a lock washer 70, or some other suitable component for affixing curtain wall member mounting apparatus 34 to curtain wall member 14. The present disclosure contemplates that mounting plate 36 may be affixed to curtain wall member 14 using any suitable mechanism.

Mounting plate 36 may include an aperture 38. In certain embodiments, aperture 38 may be a slip slot. Aperture 38 may be adapted to allow mounting plate 36 to couple to curtain wall member 14 using any suitable fastener. Aperture 38 may be any suitable shape. As one example, aperture 38 may be oval shaped. Aperture 38 may be adapted to accept a portion of a fastener 80. As an example, aperture 38 may be adapted to accept a bolt. Aperture 38 may be adapted to align with aperture 32 in curtain wall member 14. In certain embodiments, the dimensions of aperture 38 may allow for tolerance in affixing curtain wall member mounting apparatus 34 to curtain wall member 14. Built-in tolerance of aperture 38 may be advantageous in certain embodiments, such as where the location for affixing curtain wall member mounting apparatus 34 to curtain wall member 14 is subject to variation. As an example, the built-in tolerance of aperture 38 may alleviate problems associated with the location of aperture 32 in curtain wall member 14 being subject to variation within a certain range as a result of particular manufacturing processes.

Arm 46 may extend from one end of mounting plate 36. In certain embodiments, when curtain wall member mounting apparatus 34 is affixed to curtain wall member 14, arm 46 may extend toward wall 12. Arm 46 may extend perpendicular from mounting plate 36 and may have any suitable length, according to particular needs.

In certain embodiments, arm 46 may include one or more projections 48. In certain embodiments, projections 48 are substantially perpendicular to arm 46 and may be substantially vertically disposed when curtain wall member 14 is installed. In certain embodiments, projections 48 appear as teeth of a comb or tines of a fork.

Projections 48 may be spaced apart by one or more gaps such that one or more channels 50 are created adjacent to the one or more projections 48. In certain embodiments, curtain wall member mounting apparatus 34 may be oriented such that the distal end of the one or more projections 48 align with a first end of curtain wall member 14. In certain other embodiments, projections 48 may align with a second end of curtain wall member 14. Projections 48 may have varying dimensions depending on the particular application of curtain wall member mounting apparatus 34. In certain embodiments, the one or more projections 48 may be spaced evenly across arm 36 such that the one or more channels 50 adjacent projections 48 have the same width.

Curtain wall member mounting apparatus 34 may be adapted to couple to curtain wall member supporting channel 18 via projections 48 and channels 50. The one or more channels 50 of curtain wall member mounting apparatus 34 may be adapted to accept receiving-and-retaining member 24 of curtain wall member supporting channel 18. The dimensions of the one or more channels 50 may correspond to the dimensions of receiving-and-retaining member 24. The dimensions of channels 50 may vary according to the particular application of curtain wall member mounting apparatus 34. As an example, the dimensions of the one or more channels 50 created adjacent projections 48 may be determined based at least in part on the dimensions of receiving-and-retaining member 24. As a particular example, the one or more channels 50 created adjacent projections 48 may be at least wide enough for receiving-and-retaining member 24 to be inserted into channel 50, but narrow enough to prevent significant movement of curtain wall member mounting apparatus once mounted.

In certain embodiments, the use of multiple projections 48 to create a plurality of adjacent channels 50 creates a built-in shimming mechanism, which may allow an installer to vary the positioning of receiving-and-retaining member 24 in curtain wall member mounting apparatus 34. Such an embodiment may advantageously allow an installer to vary the position of curtain wall member 14 relative to receiving-and-retaining member 24 and curtain wall member supporting channel 18. As an example, embedding receiving-and-retaining member 24 in a first channel 50 may result in curtain wall member 14 failing to fit appropriately flush with a surface of curtain wall 10. By positioning receiving-and-retaining member 24 in a second channel 50, a better fit for curtain wall member 14 within curtain wall 10 may be achieved. Such an approach, therefore, may advantageously reduce or eliminate the need for traditional shimming techniques, which generally required the use of plastic shims in wall 12.

In certain embodiments, projections 48 and one or more adjacent channels 50 of curtain wall member mounting apparatus 34 may be adapted to couple to latching member 54. Latching member 54 may include a nominally horizontally-disposed latching arm 60 and a nominally vertically-disposed locating-and-retaining member 58 located at a first end of the nominally horizontally-disposed latching arm 60. In certain embodiments, latching member 54 may include one or more knobs 56 along a surface of nominally horizontally-disposed latching arm 60. Latching member 54 may also have a connection mechanism 62 positioned at a second end of latching member 54. In certain embodiments, connection mechanism 62 may be a latch. In certain other embodiments, latching member 54 may have any suitable connection mechanism.

Locating-and-retaining member 58 may extend from a first end of the nominally horizontally-disposed latching arm 60 and may be adapted to engage curtain wall member mounting apparatus 34. Curtain wall member mounting apparatus 34 may couple with locating-and-retaining member 58 of latching member 54 via projections 48 and one or more channels 50. One or more channels 50 may be adapted to accept locating-and-retaining member 58. In certain embodiments, the dimensions of the one or more channels 50 may be determined based on the dimensions of locating-and-retaining member 58. In certain embodiments, one or more channels 50 may have a suitable width for receiving both locating-and-retaining member 58 and receiving-and-retaining member 24. Such an embodiment may provide the advantage of allowing curtain wall member mounting apparatus 34 to couple to either receiving-and-retaining member 24 or locating-and-retaining member 58 without modification. Furthermore, in certain embodiments, providing a plurality of channels 50 may have the advantage of allowing the fit of curtain wall member 14 within curtain wall 10 to be optimized. As described above, such an embodiment eliminates the need for traditional shimming approaches, which may allow curtain wall members 14 to be installed more efficiently, without requiring additional components such as shims.

When the optimal channel 50 for positioning locating-and-retaining member 58 is determined, locating-and-retaining member 58 may be secured in the selected channel 50. As an example, locating-and-retaining member 58 may be secured in the selected channel 50 by joint sealant 52. In certain embodiments, joint sealant 52 may be low modulus silicone. In certain other embodiments, joint sealant 52 may be adhesive. The present disclosure contemplates any suitable manner of securing locating-and-retaining member 58 in the determined channel 50.

In certain embodiments, foam tape 64 may be secured beneath the end of nominally horizontally-disposed latching arm 60. Foam tape 64 may be positioned adjacent locating-and-retaining member 58. In certain embodiments, foam tape 64 may be placed adjacent a marking on the nominally horizontally-disposed latching arm 60 of latching member 54. The marking on latching member 54 may provide for easier installation of foam tape 64. Foam tape 64 may be operable to compress. In certain embodiments, foam tape 64 may compress as latching member 54 and connection mechanism 62 rotate into locking member 26 of curtain wall member supporting channel 18 during installation. Once latching member 54 is locked in place in locking member 26, foam tape 64 may decompress, thereby holding latching member 54 flush against supporting member 22 of curtain wall member supporting channel 18. In certain embodiments, knobs 56 may abut supporting member 22. In conjunction with foam tape 64, knobs 56 formed on the nominally horizontally-disposed latching arm 60 of latching member 54 may advantageously help maintain proper alignment between the arm 56 and the supporting member 22. Foam tape 64 may hold latching member 54 in place until the joint sealant 52, such as low modulus silicone, sets to hold latching member 54 in place. In certain embodiments, foam tape 64 may be adapted to decompose after a period of time. The present disclosure contemplates foam tape 64 being formed of any suitable material.

Mounting plate 36 of curtain wall member mounting apparatus 34 may be affixed to curtain wall member 14 by any suitable mechanism. In certain embodiments, mounting plate 36 may be affixed to curtain wall member 14 using a lock washer 70. Lock washer 70 may have a first serrated surface 72 and a second surface 74. In certain embodiments, first serrated surface 72 may be adapted to couple to second serrated surface 42 of curtain wall member mounting apparatus 34. As an example, the serrated surfaces of first serrated surface 72 and second serrated surface 42 may interlock to reduce or eliminate vertical slipping. In certain embodiments, lock washer 70 may have a length adapted to provide adequate support to mounting plate 36 when lock washer 70 is coupled to curtain wall member mounting apparatus 34. In certain embodiments, lock washer 70 may be adapted to hard load against fastener 80. In certain embodiments, interaction of curtain wall member mounting apparatus 34 with lock washer 70 may provide the ability to adjust the position of curtain wall member mounting apparatus 34 and then hard load with lock washer 70.

Lock washer 70 may include an aperture 76. Aperture 76 may be adapted to fit around a portion of a fastener 80, which may include a bolt or other suitable fastener. In certain embodiments, the diameter of aperture 76 may be substantially the same as the diameter of fastener 80. In certain embodiments, aperture 76 of lock washer 70 may be adapted to align with aperture 38 of curtain wall member mounting apparatus 34. Lock washer 70 may secure curtain wall member mounting apparatus 34 to curtain wall 30 using any suitable fastener 80. As an example, fastener 80 may include the GSE Type M6X6 Expansion Bolt System. Lock washer 70 may be adapted for a variety of uses, especially those which require hard loading with a slip slot aperture.

After installing multiple curtain wall members 14, a gap 88 may be formed between adjacent curtain wall members 14. In certain embodiments, gap 88 may be filled with any suitable gap-filling substance 89. Gap-filling substance 89 may comprise any suitable component or combination of components. As an example, and as illustrated in FIG. 2, gap-filling substance 89 may be a backer rod formed of foam. In certain embodiments, gap-filling substance 89 may be or include silicone, such as low modulus silicone. In certain embodiments, gap-filling substance 89 may reduce or prevent moisture penetration, provide additional strength and stability to curtain wall members 14, and provide a cushion allowing some movement by curtain wall members 14 due to wind load, foundation settlement, earthquakes, hurricanes, and the like.

The dimensions of the various components of curtain wall system 10 may vary according to particular applications. The present disclosure contemplates that the various components of curtain wall system 10 may have any suitable dimensions. In certain embodiments, the dimensions of the various components of curtain wall system 10 may be different from those illustrated in FIG. 2.

The present disclosure contemplates the addition of any further structural supporting elements throughout the system. For example, the curtain wall system could include one or more supporting braces on curtain wall member mounting apparatus 34. As an example, curtain wall member mounting apparatus 34 may include a supporting brace. In certain embodiments, a supporting brace may extend from a point on mounting plate 36 to a point near the distal end of arm 46. In certain embodiments, a supporting brace may be formed from the same material as other components of curtain wall member mounting apparatus 34, or may be formed from any suitable material.

Figure 3:
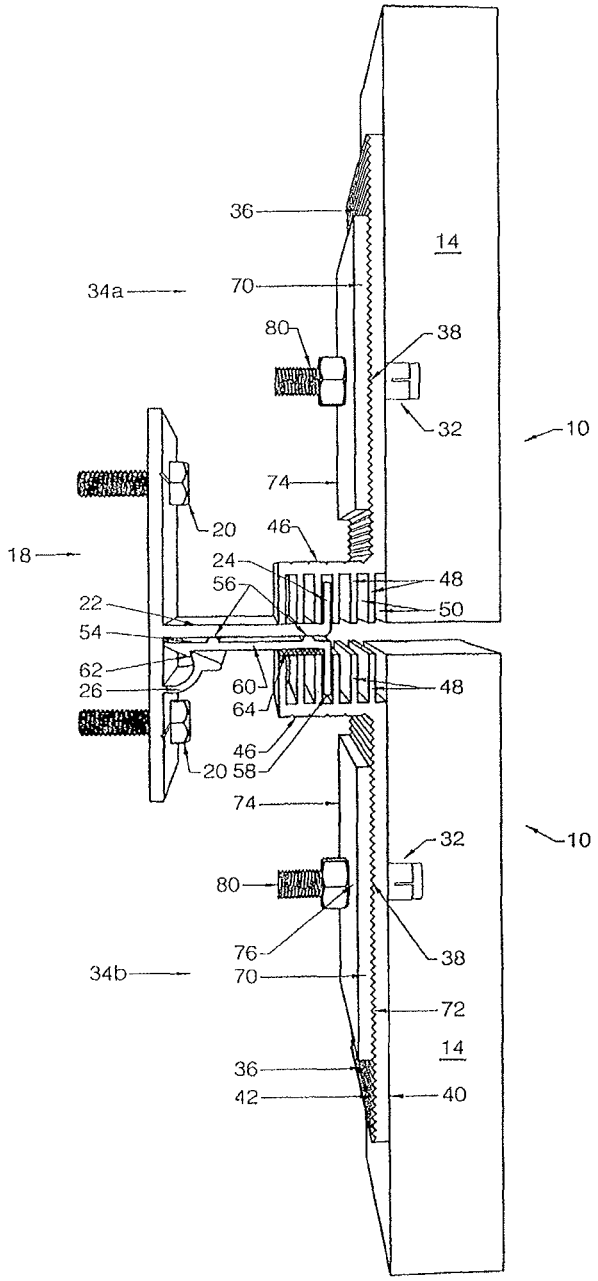
FIG. 3 illustrates an additional perspective of various details of a curtain wall system constructed in accordance with certain embodiments of the present disclosure.

FIG. 3 illustrates an additional perspective view of various details of a curtain wall system 10 constructed in accordance with certain embodiments of the present disclosure. The curtain wall system illustrated in FIG. 3 is oriented in the opposite direction of that shown in FIG. 2, such that fasteners 20 would connect to a wall or structure (not shown). Additionally, this perspective view further illustrates details of the various components of curtain wall system 10.

FIGS. 4A through 4C illustrate the curtain wall installation process in accordance with certain embodiments of the present disclosure. FIG. 4A shows a curtain wall member 14 at an initial stage of the installation process. In certain embodiments, curtain wall member 14 may have a pair of curtain wall member mounting apparatuses 34*a* and 34*b* affixed to a surface of curtain wall member 14 using lock washers 70*a* and 70*b* and fasteners 80*a* and 80*b*, respectively. In certain embodiments, and as illustrated in FIG. 4A-C, the projections 48 of curtain wall member mounting apparatuses 34*a* and 34*b* may align with opposite ends of curtain wall member 14. Depending on the particular application, however, in certain embodiments projections 48 may not align with an end of curtain wall member 14.

In certain embodiments, curtain wall member mounting apparatuses 34*a* and 34*b* may be affixed to curtain wall members 14 prior to installation. As one example, curtain wall member mounting apparatuses 34*a* and 34*b* may be affixed to curtain wall members 14 the night before curtain wall 12 is to be constructed. Affixing curtain wall member mounting apparatuses 34*a* and 34*b* to curtain wall members 14 may allow the installation process to proceed more efficiently. In certain embodiments, the process of affixing curtain wall member mounting apparatuses 34*a* and 34*b* to curtain wall members 14 may be improved as a result of built-in tolerance in aperture 38. An installer may desire that aperture 38 of curtain wall member mounting apparatuses 34*a* and 34*b* align with aperture 32 of curtain wall member 14. The location of aperture 32 on curtain wall member 14 may vary among each curtain wall member. In affixing curtain wall member mounting apparatuses 34*a* and 34*b* to curtain wall member 14, the built-in tolerance of aperture 38 may allow an installer to consistently and appropriately position curtain wall member mounting apparatuses 34*a* and 34*b* despite variations in aperture 32 of curtain wall members 14.

As illustrated in FIG. 4A, curtain wall member 14 may couple to curtain wall member supporting channel 18 via partial insertion of receiving-and-retaining member 24 in one of one or more channels 50 created adjacent projections 48 of curtain wall member mounting apparatus 34*a*. In certain embodiments, having a plurality of channels 50 adjacent projections 48 provides a built-in shimming mechanism that allows for adjustment of the fit of curtain wall member 14 without the need for separate shims. As one example, coupling receiving-and-retaining member 24 to curtain wall member mounting apparatus 34*a* in a first channel 50 may result in a poor fit of curtain wall member 14 in curtain wall 10. In such a case, an installer may adjust the fit of curtain wall member 14 in curtain wall 10 by selecting a different channel 50 for use in coupling curtain wall member mounting apparatus 34 to receiving-and-retaining member 24. This process may be repeated until the channel 50 is determined that provides an acceptable fit for curtain wall member 14 in curtain wall 10.

Also shown in FIG. 4A is latching member 54 coupled to curtain wall member mounting apparatus 34*b*. Latching member 54 may be coupled to curtain wall member mounting apparatus 34*b* by inserting locating-and-retaining member 58 of latching member 54 in one of the one or more channels 50 adjacent projections 48 of curtain wall member mounting apparatus 34*b*. Latching member 54 may be coupled to curtain wall member mounting apparatus 34*b* during the installation process. For example, latching member 54 may be coupled to curtain wall member mounting apparatus 34*b* after the proper placement of receiving-and-retaining member 24 is determined in the one or more channels 50 of curtain wall member mounting apparatus 34*a*. In certain other embodiments, latching member 54 may be coupled to curtain wall member mounting apparatus 34*b* prior to coupling curtain wall member mounting apparatus 34*a* to receiving-and-retaining member 24.

The use of curtain wall member mounting apparatus 34*b* having a plurality of channels 50 adjacent projections 48 may provide a built-in shimming mechanism. As one example, coupling locating-and-retaining member 58 to curtain wall member mounting apparatus 34*b* in a first channel 50 may result in a poor fit for curtain wall member 14 in curtain wall 10. In such a case, an installer may adjust the fit of curtain wall member 14 in curtain wall system 10 by selecting a different channel 50 to couple curtain wall member mounting apparatus 34*b* to locating-and-retaining member 58. This process may be repeated until the channel 50 providing a correct fit for curtain wall member 14 in curtain wall 10 is determined. In certain embodiments, foam tape 64 may be affixed to latching member 54 such that foam tape 64 is located between latching member 54 and projections 48 of curtain wall member mounting apparatus 34*b*. In certain embodiments, locating-and-retaining member 58 may be secured in the determined channel 50 using joint sealant 52.

With curtain wall member mounting apparatus 34*a* coupled to curtain wall member supporting channel 18 via receiving-and-retaining member 24, and latching member 54 coupled to curtain wall member mounting apparatus 34*b* via locating-and-retaining member 58, installation may proceed. In certain embodiments, curtain wall member 14 may be rotated inward in the direction of arrow 90 toward curtain wall member supporting channel 18*b*. As curtain wall member 14 is rotated in the direction of arrow 90, latching member 54 may contact a supporting member 22*b* of curtain wall member supporting channel 18*b*.

In certain embodiments, the use of curtain wall member mounting apparatuses 34 may be advantageous because it does not require the formation of kerf joints in curtain wall members 14 for positioning a component on curtain wall member 14 that is used to mount curtain wall member 14. This may be desirable in certain embodiments wherein curtain wall members 14 may be thin, so that the forming of a kerf joint may be impossible or impractical.

FIG. 4B illustrates the next stage of installation as curtain wall member 14 is rotated into place. As curtain wall member 14 is rotated inward in the direction of arrow 90, receiving-and-retaining member 24 may move more completely into the determined channel 50 of curtain wall member mounting apparatus 34*a*. As curtain wall member 14 is rotated inward in the direction of arrow 90, connection mechanism 62 or another portion of latching member 54, such as knobs 56, may contact the bottom surface of supporting member 22*b* of curtain wall member supporting channel 18. The contact of latching member 54 with the bottom portion of supporting channel 22*b* may flex latching arm 60 downward, causing foam tape 64 to compress. Curtain wall member 14 may continue to be rotated inward in the direction of arrow 90 until connection mechanism 62 engages with locking member 26 of curtain wall member supporting channel 18. In certain embodiments, the distance between a lower surface of supporting member 22 and locking member 26 is sufficient to allow connection mechanism 62 to fit through as curtain wall member 14 is rotated inward in the direction of arrow 90.

FIG. 4C illustrates the next stage of installation of curtain wall member 14. In certain embodiments, once latching member 54 is locked in place in locking member 26, foam tape 64 may decompress, ensuring proper alignment of latching member 54 against support member 22*b*. In certain embodiments, foam tape 64 beneath latching member 54 forces latching member 54 to become flush with supporting member 22*b*, setting latching member in proper engagement position. In certain embodiments, foam tape 64 may continue to hold latching member 54 in place until joint sealant 52 sets to hold latching member 54 in place. In certain embodiments, knobs 56 of nominally horizontally-disposed latching arm 60 may abut supporting member 22*b* of curtain wall member supporting channel 18*b*. In certain embodiments, knobs 56 on nominally horizontally-disposed latching arm 60 of latching member 54 may advantageously help maintain proper alignment between the nominally horizontally-disposed latching arm 60 and supporting member 22*b*.

During installation, the resulting fit of curtain wall member 14 in curtain wall 10 may not be acceptable. In certain circumstances, ill-fitting curtain wall member 14 may cause wall waffle. As described above in relation to FIG. 4A, the built in shimming mechanism of curtain wall member mounting apparatuses 34*a* and 34*b* may advantageously allow for adjustment of the fit of curtain wall member 14 without using separate shims. In certain embodiments, the fit of a curtain wall member 14 may be corrected by adjusting the position of receiving-and-retaining member 24 in curtain wall member mounting apparatus 34*a*, without additional shimming on the substrate side. By positioning receiving-and-retaining member in a different channel 50 adjacent the projections 48 of curtain wall member mounting apparatus 34*a*, a better fit may be obtained. Similarly, the fit of curtain of wall member 30 may be adjusted by re-positioning locating-and-retaining member 58 in a different channel 50 adjacent the projections 48 of curtain wall member mounting apparatus 34*b*. Depending on the circumstances, one or both of the positions of receiving-and-retaining member 24 or locating-and-retaining member 58 may be adjusted to obtain a better fit for curtain wall member 14 in curtain wall 10.

Figure 5:
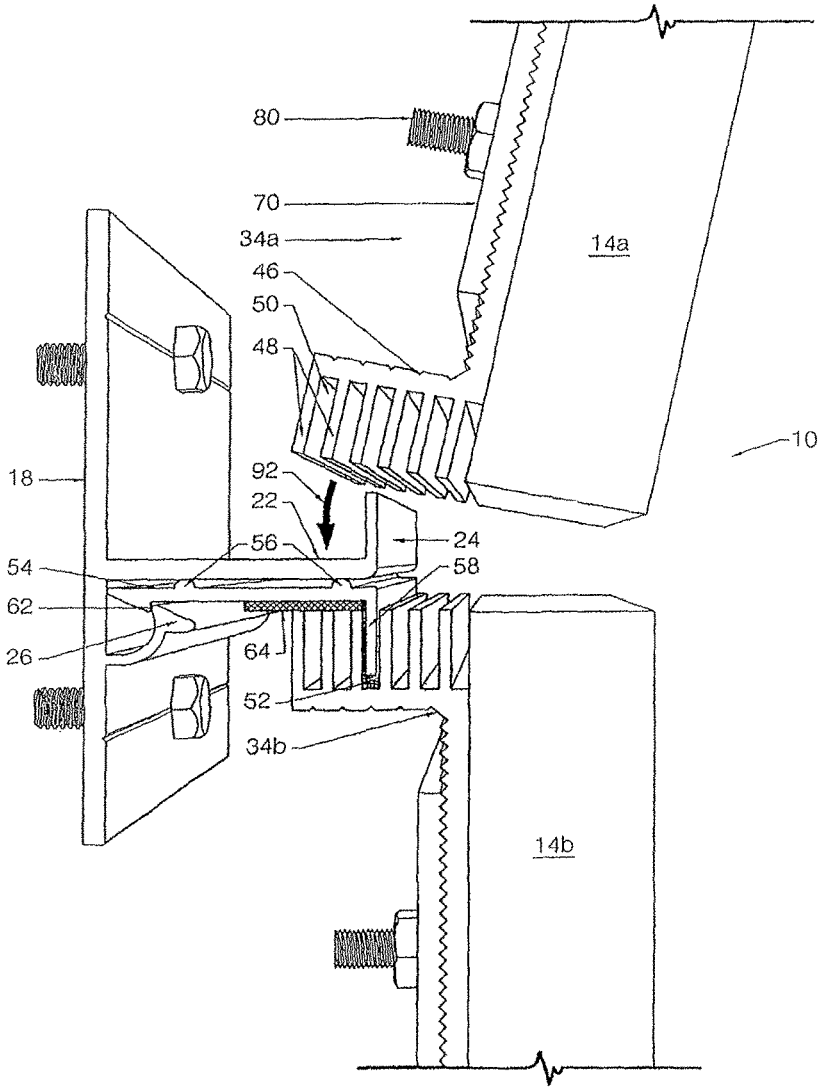
FIG. 5 illustrates the setting of a curtain wall member in accordance with certain embodiments of the present disclosure.

FIG. 5 illustrates the setting of a curtain wall member 14 in accordance with certain embodiments of the present disclosure. A first curtain wall member mounting apparatus 34*a* may be affixed to one end of curtain wall member 14*a* via lock washer 70 and fastener 80. In certain embodiments, and as illustrated in FIG. 5, curtain wall member mounting apparatus 34*a* may be oriented such that projections 48 of curtain wall member mounting apparatus 34*a* align with an end of curtain wall member 14. In certain other embodiments, however, projections 48 of curtain wall member mounting apparatus 34*a* need not align with an end of curtain wall member 14.

Curtain wall member 14*a* may be coupled to supporting member 22 of curtain wall member supporting channel 18 by receiving-and-retaining member 24. During installation, curtain wall member 14 may move in the direction illustrated by arrow 92 such that one of the one or more channels 50 created adjacent projections 48 is aligned to accept receiving-and-retaining member 24. In certain embodiments, during the initial stage of installation, receiving-and-retaining member 24 may be partially inserted in one of the one or more channels 50. As curtain wall member 14 rotationally engages with curtain wall member supporting channel 18, receiving-and-retaining member 24 may be further inserted in the determined channel 50.

Also shown in FIG. 5 is a second curtain wall member 14*b* installed in curtain wall 10. In certain embodiments, a second curtain wall member mounting apparatus 34*b* may be affixed to an end of curtain wall member 14*b*. Latching member 54 may be coupled to curtain wall member mounting apparatus 34*b* using locating-and-retaining member 58. Connection mechanism 62 of latching member 54 may be engaged with locking member 26 of curtain wall supporting channel 18. Foam tape 64 may be decompressed, forcing latching member 54 into proper alignment with supporting member 22 of curtain wall member supporting channel 18. Knobs 56 of latching member 54 may contact supporting member 22. In certain embodiments, joint sealant 52 may secure locating-and-retaining member 58 in place. Over time, foam tape 64 may decompose, leaving latching member 54 secured by joint sealant 52.

Figure 6:
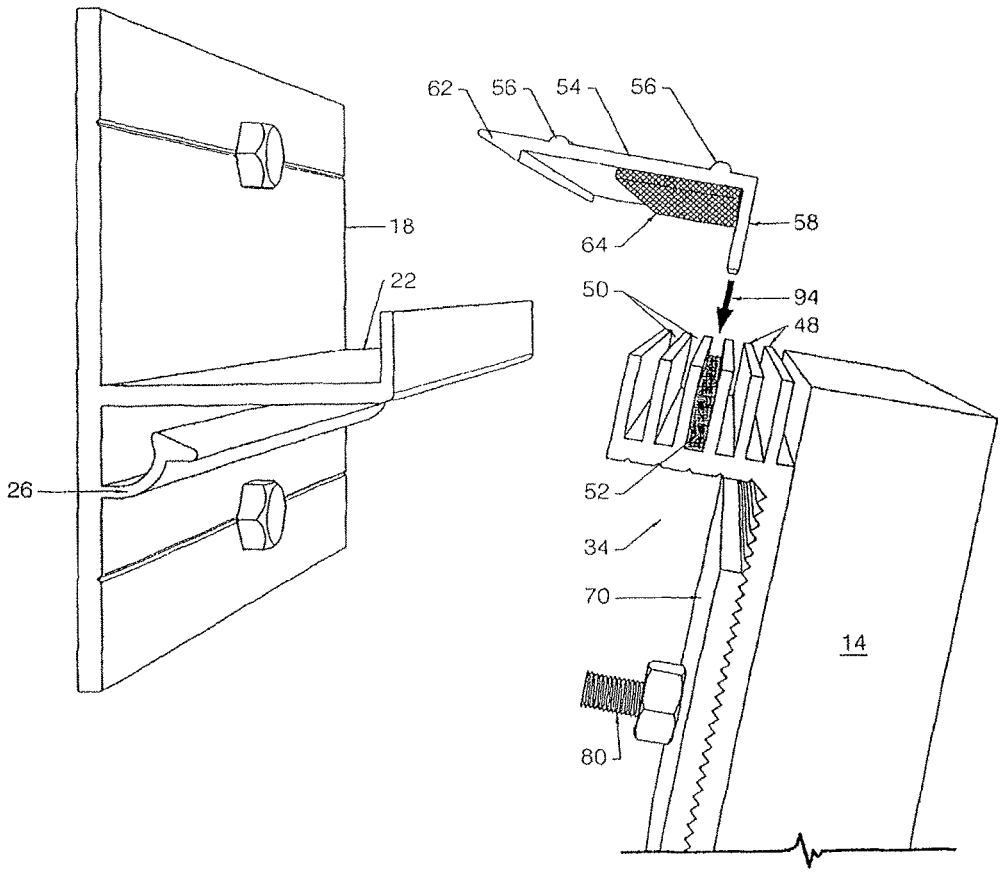
FIG. 6 illustrates placement of a latching member in accordance with certain embodiments of the present disclosure.

FIG. 6 illustrates placement of a latching member 54 in accordance with certain embodiments of the present disclosure. Curtain wall member 14 may have a curtain wall member mounting apparatus 34 affixed to it using lock washer 70 and fastener 80. In certain embodiments, projections 48 may be aligned with an end of curtain wall member 14. In certain embodiments, latching member 54 may be coupled to curtain wall member mounting apparatus 34 using locating-and-retaining member 58. Locating-and-retaining member 58 may be adapted to fit into multiple channels 50 created adjacent projections 48. Although locating-and-retaining member 58 is shown aligned with a single channel 50 adjacent projections 48 (illustrated by arrow 94), locating-and-retaining member 58 may be adapted to couple to curtain wall member mounting apparatus 34 using a plurality of channels 50, which may allow for adjustment of the position of curtain wall member 14 in curtain wall 10.

In certain embodiments, the placement of locating-and-retaining member 58 in curtain wall member mounting apparatus 34 may be adjusted to provide a proper fit for curtain wall member 14 in curtain wall 10, providing a built-in shimming mechanism that reduces or eliminates the need for shims. When the proper channel 50 is determined, joint sealant 52 may be applied to the determined channel 50. Joint sealant 52 may be applied in any suitable way. As one example, locating-and-retaining member 58 may be removed from the determined channel 50 so that joint sealant 52 may be applied before placing locating-and-retaining member 58 back in the determined channel 50. In certain embodiments, joint sealant 52 may be adapted to secure locating-and-retaining member 58 in the determined channel 50. Joint sealant 52 may be any suitable material. As one example, joint sealant 52 may be low modulus silicone.

During installation, foam tape 64 may compress as curtain wall member 14 is rotated inward toward curtain wall member supporting channel 18, and then decompress once latching member 54 has engaged locking member 26 via connection mechanism 62. Decompression of foam tape 64 may ensure proper alignment of latching member 54 against supporting member 22 while joint sealant 52 sets. In certain embodiments, upon setting joint sealant 52 may hold latching member 54 in place. In certain embodiments, foam tape 64 may eventually decompose.

Figure 7A:
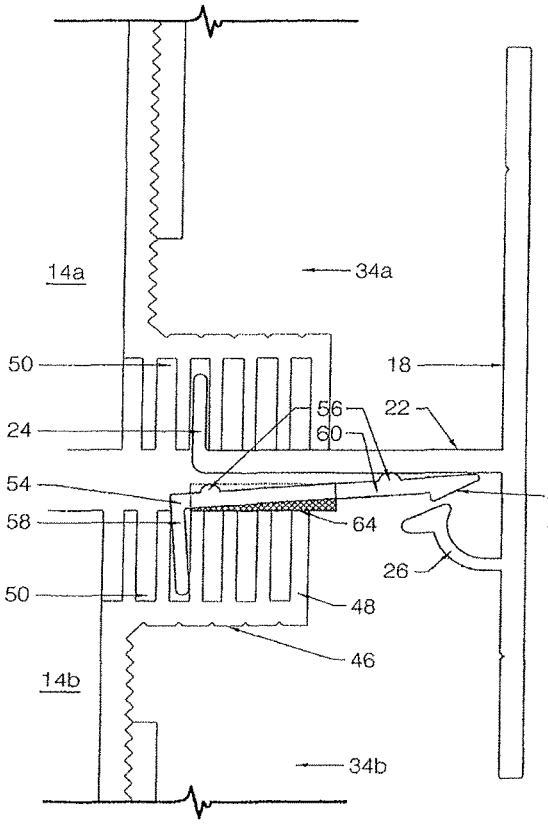
FIGS. 7A and 7B illustrate in greater detail the rotational engagement of a latching member with a curtain wall member supporting channel in accordance with certain embodiments of the present disclosure.
Figure 7B:
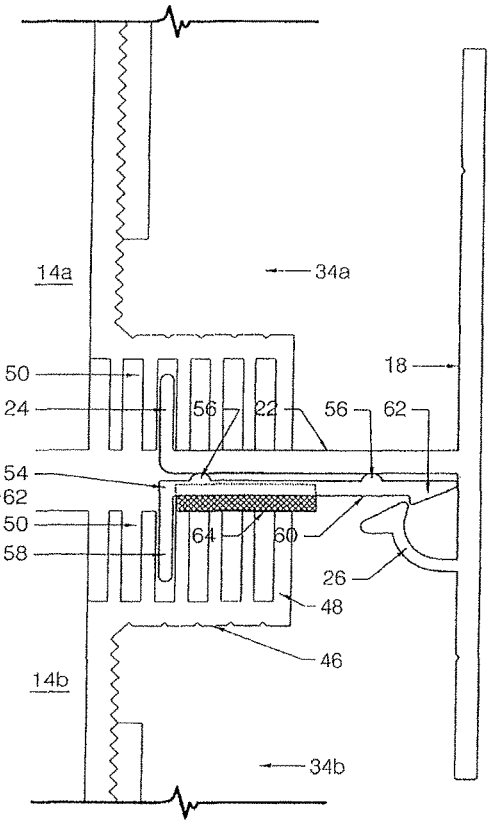

FIGS. 7A and 7B illustrate in greater detail the rotational engagement of latching member 54 with a curtain wall member supporting channel 18 in accordance with certain embodiments of the present disclosure. More particularly, FIG. 7A illustrates the rotation of latching member 54, and FIG. 7B illustrates latching member 54 engaging with curtain wall member supporting channel 18. In certain embodiments, before rotationally engaging curtain wall member 14 into curtain wall member supporting channel 18, locating-and-retaining member 58 of latching member 54 is positioned in one of the one or more channels 50 adjacent the one-or more projections 48 of arm 46 of curtain wall member mounting apparatus 34*b*. The position of locating-and-retaining member 58 in the one or more channels 50 may be adjusted while installing curtain wall member 14 to ensure a proper fit of curtain wall member 14 in curtain wall 10. In certain embodiments, curtain wall member mounting apparatus 34 may be affixed to curtain wall members 14 before beginning installation of curtain wall 10, allowing the actual installation process to proceed faster.

As illustrated in FIG. 7A, an upper curtain wall member 14*a* may be supported on a curtain wall member supporting channel 18 by receiving-and-retaining member 24 received in one of the one or more channels 50 of a curtain wall member mounting apparatus 34*a*. Latching member 54 may be coupled to a second curtain wall member mounting apparatus 34*b* affixed to a lower curtain wall member 14*b* by positioning locating-and-retaining member 58 of latching member 54 in one of the one or more channels 50 of curtain wall member mounting apparatus 34*b* affixed to lower curtain wall member 14*b*. In certain embodiments, locating-and-retaining member 58 may be secured in the channel 50 by a quantity of silicone.

As lower curtain wall member 14*b* is rotated inwardly toward curtain wall member supporting channel 18, connection mechanism 62 of latching member 54 may contact the bottom surface of supporting channel 22 of curtain wall member supporting channel 18. As lower curtain wall member 14*b* continues to rotate inwardly, continued contact of supporting channel 22 by connection mechanism 62 may cause foam tape 64 to compress, allowing latching member 54 and connection mechanism 62 to rotate into locking member 26 of curtain wall member supporting channel 18. In certain embodiments, compression of foam tape 64 may allow connection mechanism 62 to move past locking member 26. As foam tape 64 decompresses, the angle of nominally horizontally-disposed latching arm 60 may be shifted so that it becomes flush with support member 22 of curtain wall member supporting channel 18. In certain embodiments, decompression of foam tape 64 may cause connection mechanism 62 to rotate downward and become secured by locking member 26. In certain embodiments, further inward movement of the lower curtain wall member 14*b* is prevented by engagement of the distal end of connection mechanism 62 with a stop of channel 18.

As illustrated in FIG. 7B, once latching member 54 is locked in place in locking member 26, foam tape 64 may decompress, thereby holding the latching member 54 flush against the support member 22 until the joint sealant 52 sets to hold the latching member 54 in place. In certain embodiments, knobs 56 of nominally horizontally-disposed latching arm 60 may abut supporting member 22 of curtain wall member supporting channel 18. In certain embodiments, knobs 56 formed on the nominally horizontally-disposed latching arm 60 of latching member 54 may advantageously maintain proper alignment between the arm 56 and the supporting member 22.

Figure 8:
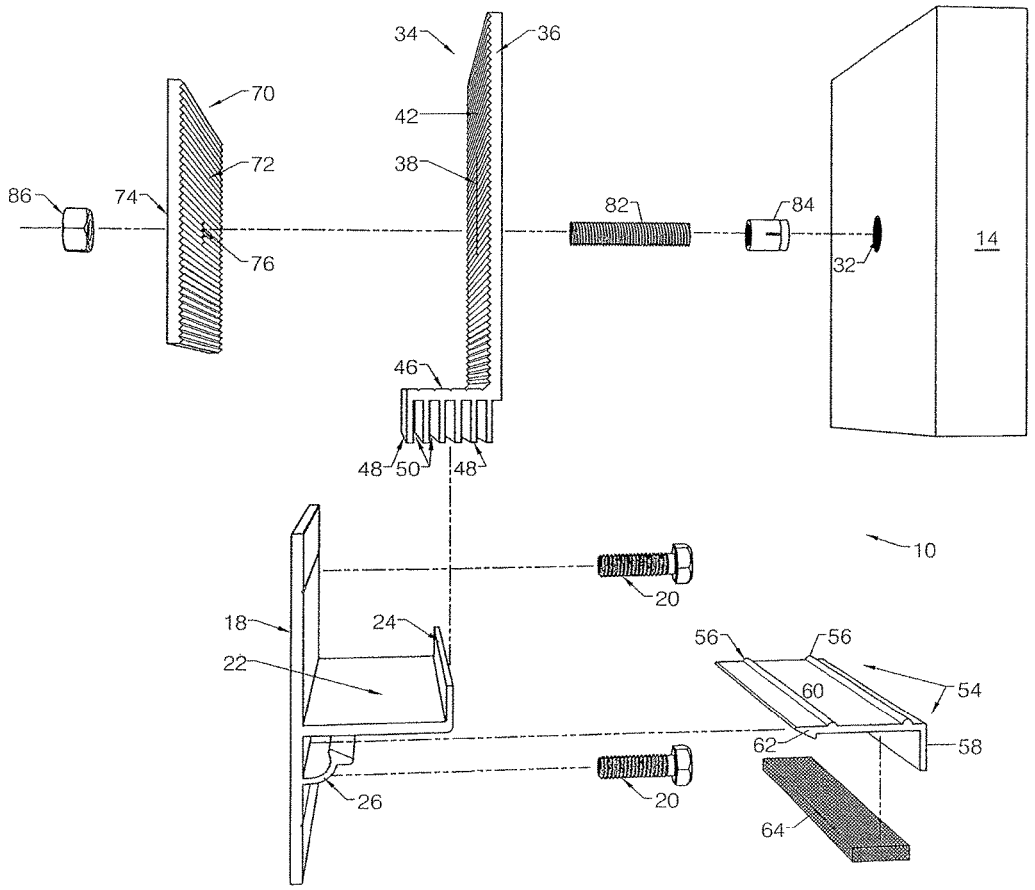
FIG. 8 shows an exploded view of various components of a curtain wall system in accordance with certain embodiments of the present disclosure.

FIG. 8 shows an exploded view of various components of curtain wall system 10 in accordance with certain embodiments of the present disclosure. In certain embodiments, curtain wall system 10 may include a curtain wall member supporting channel 18, curtain wall member 14, curtain wall member mounting apparatus 34, and lock washer 70. In certain embodiments, curtain wall member mounting apparatus 34 may be adapted to couple to a surface of curtain wall member 14. Curtain wall member mounting apparatus 34 may have a mounting plate 36, an aperture 38, and an arm 46. Curtain wall member mounting apparatus 34 may be adapted to couple to curtain wall member 14 using a fastener 80 accepted through aperture 38 of mounting plate 36. In certain embodiments, curtain wall member 14 may have an aperture 32. Aperture 32 may be designed to accept a portion of a fastener 80.

Serrated first surface 72 of lock washer 70 may be adapted to couple with second serrated surface 42 of curtain wall member mounting apparatus 34. For example, the serrated edges of serrated first surface 72 and serrated surface 42 may interlock. When serrated first surface 72 and second serrated surface 42 are coupled, aperture 38 of mounting plate 36 and aperture 76 of lock washer 70 may align. In coupling curtain wall member mounting apparatus 34 to curtain wall member 14, apertures 38 and 76 may align with aperture 32 of curtain wall member 14. Apertures 38, 76, and 32 may accept a portion of a fastener 80. Fastener 80 may be any suitable fastener. In certain embodiments, fastener 80 may include a bolt 82, a receiving portion 84, and a nut 86. In certain embodiments, the diameter of fastener 80 may be substantially the same as the diameter of aperture 76 of lock washer 70. In certain embodiments, receiving portion 84 may be an undercut plug anchor. In certain other embodiments, receiving portion 84 may be a receiving component such as the one included in the GSE Type M6X6 Expansion Bolt System. Upon coupling to curtain wall member 14, projections 48 of arm 46 may align with an end of curtain wall member 14.

Arm 46 may extend from one end of mounting plate 36. In certain embodiments, arm 46 may extend substantially perpendicularly from mounting plate 36. Arm 46 may include one or more projections 48. Projections 48 may be spaced apart by one or more gaps such that one or more channels 50 are created adjacent to the one or more projections 48. In certain embodiments, curtain wall member mounting apparatus 34 may be oriented such that the distal end of the one or more projections 48 align with a first end of curtain wall member 14. Projections 48 may have varying dimensions depending on the particular application of curtain wall member mounting apparatus 34. In certain embodiments, the one or more projections 48 may be spaced evenly across arm 36 such that the one or more channels 50 adjacent projections 48 have the same width.

Curtain wall member supporting channel 18 may be adapted to couple to a wall using a plurality of fasteners 20. Fasteners 20 may be any suitable fasteners. As an example, fasteners 20 may be screws. Curtain wall member supporting channel 18 may have a supporting member 22. In certain embodiments, supporting member 22 may extend substantially perpendicularly outwardly from a wall. A receiving-and-retaining member 24 may be located at and extend substantially perpendicularly from the distal end of supporting member 22. In certain embodiments, curtain wall member supporting channel 18 is includes a locking member 26. Locking member 26 may be adapted to couple with a connection mechanism 62 of latching member 54.

Curtain wall member mounting apparatus 34 may be adapted to couple to curtain wall member supporting channel 18 via projections 48 and the one or more adjacent channels 50. In certain embodiments, the one or more channels 50 may be adapted to accept receiving-and-retaining member 24. The dimensions of channels 50 may correspond to the dimensions of receiving-and-retaining member 24. The dimensions of the one or more channels 50 may vary according to the particular application of curtain wall member mounting apparatus 34. As an example, the dimensions of the one or more channels 50 adjacent projections 48 may be determined based at least in part on the dimensions of receiving-retaining-member 24. Although FIG. 8 illustrates receiving-and-retaining member 24 aligned with a particular channel 50, receiving-and-retaining member 24 may be adapted to couple to curtain wall member mounting apparatus 34 using more than one of the one or more channels 50. In certain embodiments, the use of plurality of projections 48 to create a plurality of adjacent channels 50 creates a built-in shimming mechanism, which may allow an installer to vary the positioning of receiving-and-retaining member 24 in curtain wall member mounting apparatus 34. Such an embodiment may advantageously allow an installer to vary the position of curtain wall member 14 relative to receiving-and-retaining member 24 and curtain wall member supporting channel 18. As an example, embedding receiving-and-retaining member 24 in a first channel 50 may result in curtain wall member 14 failing to fit appropriately flush with a surface of curtain wall 10. By positioning receiving-and-retaining member 24 in a second channel 50, a better fit for curtain wall member 14 may be achieved. The channel 50 providing the best fit may be determined during installation, and the placement of receiving-and-retaining member varied accordingly.

Also shown in FIG. 8 is an exploded view of latching member 54 in relation to curtain wall member supporting channel 18. In certain embodiments, latching member 54 includes a nominally horizontally-disposed latching arm 60 and a vertically-disposed locating-and-retaining member 58 located at a first end of horizontally disposed portion 60. Nominally horizontally-disposed latching arm 60 may include one or more knobs 56. Although FIG. 8 illustrates a single curtain wall member mounting apparatus 34 with its projections 48 oriented downward for coupling to receiving-and-retaining member 24, in certain embodiments a curtain wall member mounting apparatus 34 may also be affixed to a curtain wall member 14 such that the projections 48 are oriented upward. In such an embodiment, the projections 48 and one or more adjacent channels 50 may be adapted to couple to latching member 54. Latching member 54 may couple to a curtain wall member mounting apparatus 34 via locating-and-retaining member 58. Locating-and-retaining member 58 may couple to curtain wall member mounting apparatus 34 in a manner similar to that of receiving-and-retaining member 24 described above. In certain embodiments, locating-and-retaining member 58 is adapted to couple to curtain wall member mounting apparatus 34 via projections 48 and one or more adjacent channels 50. Once the channel 50 providing the best fit for curtain wall member 14 is determined, locating-and-retaining member 58 may be secured using joint sealant 52.

Latching member 54 may be adapted to couple to curtain wall member supporting channel 18. Latching member 54 may couple to curtain wall member supporting channel 18 at locking member 26 via connection mechanism 62 positioned at a second end of latching member 54. Connection mechanism 62 may be any suitable connection mechanism. As an example, connection mechanism 62 may be a latch.

In certain embodiments, foam tape 64 may be secured beneath the nominally horizontally-disposed latching arm 60 of latching member 54. Nominally horizontally-disposed latching arm 60 may include a mark indicating where foam tape 64 should be placed. In certain embodiments, foam tape 64 may be secured adjacent locating-and-retaining member 58. Foam tape 64 may be operable to compress to allow latching member 54 and connection mechanism 62 to rotate into locking member 26 of curtain wall member supporting channel 18. Once latching member 54 is locked in place, foam tape 64 may decompress, thereby holding latching member 54 snugly against support member 22 of curtain wall member supporting channel 18. In certain embodiments, knobs 56 may abut nominally horizontally-disposed latching arm 60. In certain embodiments, knobs 56 formed on the nominally horizontally-disposed latching arm 60 of latching member 54 may advantageously maintain proper alignment between the nominally horizontally-disposed latching arm 60 and the supporting member 22. As an example, foam tape 64 may hold latching member 54 in place until low modulus silicone 52 sets to hold the latching member 54 in place. In certain embodiments, foam tape 64 may be adapted to decompose after a certain period of time. The present disclosure contemplates that foam tape 64 may be formed of any suitable material.

Figure 9A:
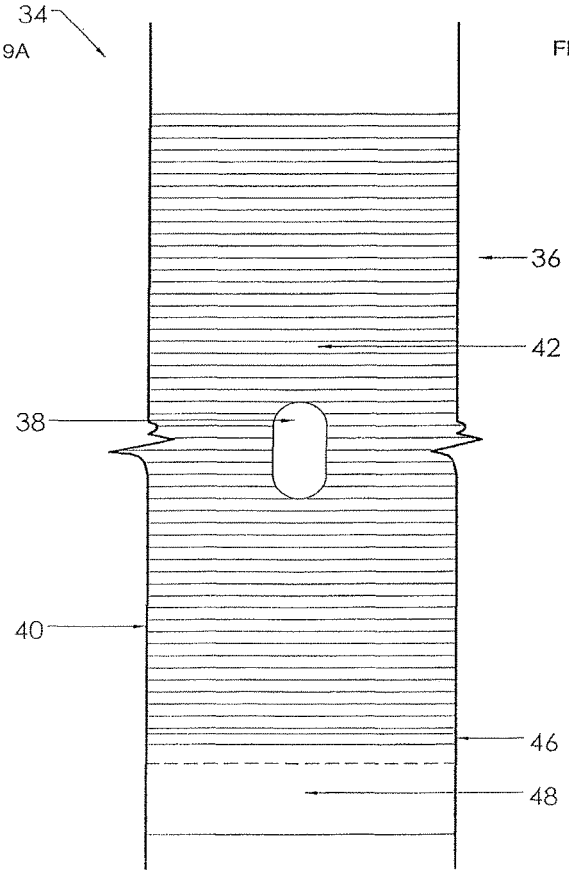
FIGS. 9A and 9B illustrate elevation and section views, respectively, of a curtain wall member mounting apparatus in accordance with certain embodiments of the present disclosure.
Figure 9B:
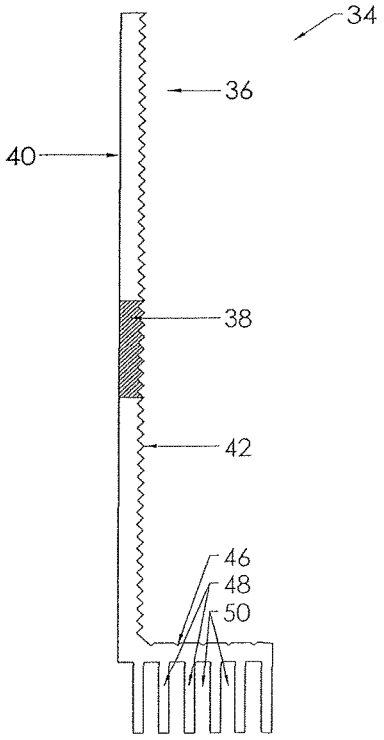

FIGS. 9A and 9B illustrate elevation and section views, respectively, of a curtain wall member mounting apparatus 34 in accordance with certain embodiments of the present disclosure. FIG. 9A illustrates an elevation view of curtain wall member mounting apparatus 34 in accordance with certain embodiments of the present disclosure. In certain embodiments, curtain wall member mounting apparatus 34 may include a mounting plate 36 and an arm 46.

Mounting plate 36 may have a first surface 40 and a second surface 42 opposite the first surface 40. In certain embodiments, second surface 42 may be serrated. Second serrated surface 42 may be adapted to couple to a corresponding serrated surface of a lock washer or other suitable fastener. The dimensions of mounting plate 36 may vary depending on the particular application of curtain wall member mounting apparatus 34. The present disclosure contemplates that mounting plate 36 may have any suitable dimensions.

Mounting plate 36 may include an aperture 38. Aperture 38 may be adapted to allow mounting plate 36 to couple to a curtain wall member using any suitable fastener. Aperture 38 may be any suitable shape. As an example, aperture 38 may have a substantially oval shape. Aperture 38 may be adapted to accept a portion of a fastener 80. As an example, aperture 38 may be adapted to accept a bolt. Aperture 38 may be adapted to align with an aperture of a curtain wall member. The dimensions of aperture 38 may vary depending on the particular application of curtain wall member mounting apparatus 34, and may allow for tolerance in affixing curtain wall member mounting apparatus 34 to curtain wall member 14. In certain embodiments, built-in tolerance of aperture 38 may be advantageous. As an example, the built-in tolerance may be advantageous in circumstances where the location of a corresponding aperture in a curtain wall member is subject to variation.

Arm 46 may extend from one end of mounting plate 36. In certain embodiments, arm 46 may extend substantially perpendicularly from mounting plate 36. Arm 46 may include one or more projections 48. Projections may be arranged such that one or more channels are created adjacent to the one or more projections. The dimensions of arm 46 and projections 48 may vary depending on the particular application of curtain wall member mounting apparatus 34.

FIG. 9B illustrates a section view of curtain wall member mounting apparatus 34 in accordance with certain embodiments of the present disclosure. In certain embodiments, curtain wall member mounting apparatus 34 may include a mounting plate 36 and an arm 46.

Mounting plate 36 may have a first surface 40 and a second surface 42 opposite the first surface 40. In certain embodiments, second surface 42 may be serrated. Second serrated surface 42 may be adapted to couple to a corresponding serrated surface of a lock washer or other suitable fastener. Mounting plate 36 may also include an aperture 38.

Arm 46 may extend from one end of mounting plate 36. In certain embodiments, arm 46 may extend substantially perpendicularly from mounting plate 36. Arm 46 may include one or more projections 48. The one or more projections 48 may be spaced apart by one or more gaps such that one or more channels 50 are created adjacent to the one or more projections 48. In certain embodiments, the one or more projections 48 may be spaced evenly across arm 36 such that the one or more channels 50 adjacent projections 48 have the same width.

In certain embodiments, curtain wall member mounting apparatus 34 may be adapted to couple to a curtain wall member supporting channel 18 using projections 48 and channels 50. In certain embodiments, the one or more channels 50 may be adapted to accept a receiving-and-retaining member 24 of a curtain wall member supporting channel 18. The dimensions of the one or more channels 50 may correspond to the dimensions of receiving-and-retaining member 24. The dimensions of channels 50 may vary according to the particular application of curtain wall member mounting apparatus 34. As an example, the dimensions of the one or more channels 50 created adjacent projections 48 may be determined based at least in part on the dimensions of receiving-retaining-member 24. In certain other embodiments, curtain wall member mounting apparatus 34 may couple to locating-and-retaining member 58 in a similar fashion. In certain embodiments, locating-and-retaining member 58 may have the same dimensions as receiving-and-retaining member 24.

In certain embodiments, the use of a plurality of projections 48 to create a plurality of adjacent channels 50 creates a built-in shimming mechanism, which may allow an installer to vary the positioning of receiving-and-retaining member 24 or locating-and-retaining member 58 in curtain wall member mounting apparatus 34. Such an embodiment may advantageously allow an installer to vary the position of curtain wall member 14 relative to receiving-and-retaining member 24 and curtain wall member supporting channel 18 by selecting from among the one or more channels 50 the one that provides the best fit for curtain wall member 14. The dimensions of arm 46 and projections 48 may vary depending on the particular application of curtain wall member mounting apparatus 34.

The dimensions of the various components of curtain wall member mounting apparatus 34 may vary according to particular applications. The present disclosure contemplates that the various components of curtain wall member mounting apparatus 34 may have any suitable dimensions. In certain embodiments, the dimensions of the various components of curtain wall member mounting apparatus 34 may be different from those illustrated in FIGS. 9A and 9B.

Figure 10A:
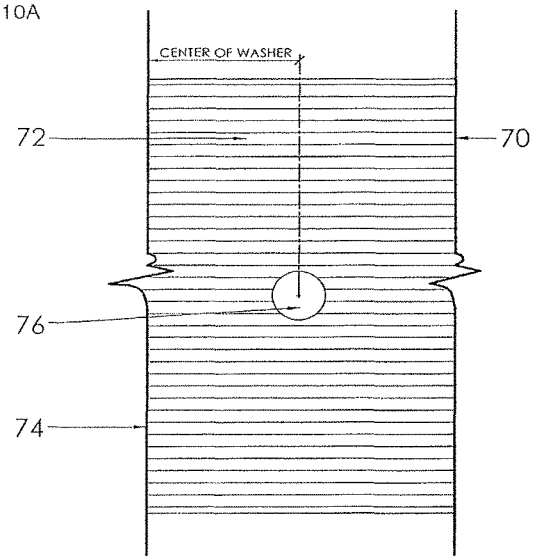
FIGS. 10A and 10B illustrate elevation and section views, respectively, of a lock washer in accordance with certain embodiments of the present disclosure.
Figure 10B:
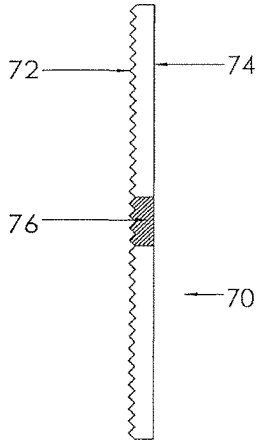

FIGS. 10A and 10B illustrate elevation and section views, respectively, of a lock washer 70 in accordance with certain embodiments of the present disclosure. FIG. 10A illustrates an elevation view of lock washer 70 in accordance with an embodiment of the present disclosure. Lock washer 70 may include a serrated first surface 72 and a second surface 74 opposite the serrated first surface 72. In certain embodiments, serrated first surface 72 may be adapted to couple to second serrated surface 42 of a curtain wall member mounting apparatus 34. Lock washer 70 may be of any suitable dimensions. In certain embodiments, the dimensions of lock washer 70 may be adapted to provide support to mounting plate 36 of curtain wall member mounting apparatus 34. In certain embodiments, lock washer 70 may be adapted to hard load against a fastener. Lock washer 70 may also include an aperture 76. Aperture 76 may be adapted to align with aperture 38 of curtain wall member mounting apparatus 34. Aperture 76 may be adapted to fit around a portion of a fastener, which may include a bolt. Lock washer 70 may secure curtain wall member mounting apparatus 34 to curtain wall member 14 using any suitable fastener.

FIG. 10B illustrates a section view of lock washer 70 in accordance with an embodiment of the present disclosure. Lock washer 70 may include a serrated first surface 72 and a second surface 74. In certain embodiments, serrated first surface 72 may be adapted to couple to a second serrated surface 42 of curtain wall member mounting apparatus 34. Lock washer 70 may include an aperture 76.

The dimensions of lock washer 70 may vary according to particular applications. The present disclosure contemplates that lock washer 70 may have any suitable dimensions. In certain embodiments, the dimensions of lock washer 70 may be different from those illustrated in FIGS. 10A and 10B.

Although the present disclosure has been described with several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims. Although the figures and accompanying description may describe a curtain wall system in accordance with certain embodiments of the present disclosure that is oriented in a particular direction, the present disclosure contemplates that the orientation of the curtain wall system and its various components may be varied in any suitable manner. As an example, the described supporting structures may be modified such that the orientation of the curtain wall system is substantially flipped.

What is claimed is:

1. A method, comprising:

embedding a receiving-and-retaining member of a first curtain wall member supporting channel in a first channel of a plurality of channels of a first curtain wall member mounting apparatus, the plurality of channels being defined by a plurality of projections of the first curtain wall member mounting apparatus, the first curtain wall member mounting apparatus being coupled to a first end of a first curtain wall member and further comprising:

a mounting plate; and an arm having the plurality of projections; and rotating the first curtain wall member inwardly toward a second curtain wall member supporting channel such that a connection mechanism at a second end of the first curtain wall member engages with the second curtain wall member supporting channel to retain the curtain wall member in position.

2. The method of claim 1, further comprising affixing the first curtain wall member mounting apparatus to the first end of the first curtain wall member.

3. The method of claim 1, wherein the connection mechanism comprises a second curtain wall member mounting apparatus.

4. The method of claim 3, further comprising embedding a locating-and-retaining member of a latching member in a channel adjacent to one or more projections of the second curtain wall member mounting apparatus, the locating-and-retaining member being vertically disposed downward at a first end of a horizontally-disposed latching arm of the latching member.

5. The method of claim 4, wherein the latching member further comprises a second end of the horizontally-disposed latching arm adapted to slide along a lower surface of a supporting member of the second curtain wall member supporting channel until a latch at the second end of the horizontally-disposed latching arm of the latching member comes into latching engagement with a locking member disposed beneath the lower surface of the supporting member of the second curtain wall member supporting channel.

6. The method of claim 4, wherein:

the second curtain wall member mounting apparatus comprises:

a mounting plate; and an arm having the one or more projections of the second curtain wall member mounting apparatus; and embedding the locating-and-retaining member of the latching member in the channel adjacent to the one or more projections of the second curtain wall member mounting apparatus comprises engaging the locating-and-retaining member with a channel formed between first and second projections of the one or more projections of the second curtain wall member mounting apparatus.

7. The method of claim 4, wherein rotating the first curtain wall member inwardly toward the second curtain wall member supporting channel such that the connection mechanism at the second end of the first curtain wall member engages with the second curtain wall member supporting channel to retain the curtain wall member in position comprises rotating the first curtain wall member until a latch at a second end of the horizontally-disposed latching arm of the latching member comes into latching engagement with a locking member disposed beneath a lower surface of the supporting member of the second curtain wall member supporting channel.

8. The method of claim 4, wherein:

the first channel of the first curtain wall member mounting apparatus is between a first projection and a second projection of the plurality of projections of the first curtain wall member mounting apparatus; and the method further comprises adjusting a fit of the first curtain wall member in a curtain wall by performing acts comprising:

removing the receiving-and-retaining member of the first curtain wall member supporting channel from the channel between the first projection and the second projection of the plurality of projections of the first curtain wall member mounting apparatus; and embedding the receiving-and-retaining member of the first curtain wall member supporting channel in a second channel of the plurality of channels of the first curtain wall member mounting apparatus, the second channel being between the second projection and a third projection of the plurality of projections of the first curtain wall member mounting apparatus.

9. The method of claim 1, wherein the mounting plate of the first curtain wall member mounting apparatus comprises:

a first surface;

a second serrated surface opposite the first surface; and an aperture.

10. The method of claim 9, wherein the first curtain wall member mounting apparatus is coupled to the first end of the first curtain wall member by a lock washer, the lock washer comprising:

a first serrated surface and a second surface, the first serrated surface adapted to couple to the second serrated surface of the mounting plate of the first curtain wall member mounting apparatus;

an aperture; and a fastener adapted to couple the mounting plate of the first curtain wall member mounting apparatus to the first curtain wall member.

11. The method of claim 9, wherein the aperture of the mounting plate of the first curtain wall member mounting apparatus is shaped to allow for tolerance in affixing the first curtain wall member mounting apparatus to the first curtain wall member.

12. A method, comprising:

embedding a receiving-and-retaining member of a first curtain wall member supporting channel in a first channel of a plurality of channels of a first curtain wall member mounting apparatus, the plurality of channels being defined by a plurality of projections of the first curtain wall member mounting apparatus, the first curtain wall member mounting apparatus being coupled to a first end of a first curtain wall member and further comprising:

a mounting plate; and an arm having the plurality of projections;

removing the receiving-and-retaining member of the first curtain wall member supporting channel from the first channel of the plurality of channels of the first curtain wall member mounting apparatus; and embedding the receiving-and-retaining member of the first curtain wall member supporting channel in a second channel of the plurality of channels of the first curtain wall member mounting apparatus.

13. The method of claim 12, further comprising rotating, subsequent to embedding the receiving-and-retaining member of the first curtain wall member supporting channel in the second channel of the plurality of channels of the first curtain wall member mounting apparatus, the first curtain wall member inwardly toward a second curtain wall member supporting channel such that a connection mechanism at a second end of the first curtain wall member engages with the second curtain wall member supporting channel to retain the curtain wall member in position.

14. The method of claim 13, wherein:

the connection mechanism comprises a second curtain wall member mounting apparatus; and the method further comprises embedding a locating-and-retaining member of a latching member in a channel adjacent to one or more projections of the second curtain wall member mounting apparatus, the locating-and-retaining member being vertically disposed downward at a first end of a horizontally-disposed latching arm of the latching member.

15. The method of claim 14, wherein:

the second curtain wall member mounting apparatus comprises:

a mounting plate; and an arm having the one or more projections of the second curtain wall member mounting apparatus; and embedding the locating-and-retaining member of the latching member in the channel adjacent to the one or more projections of the second curtain wall member mounting apparatus comprises engaging the locating-and-retaining member with a channel formed between first and second projections of the one or more projections of the second curtain wall member mounting apparatus.

16. The method of claim 14, wherein rotating the first curtain wall member inwardly toward the second curtain wall member supporting channel such that the connection mechanism at the second end of the first curtain wall member engages with the second curtain wall member supporting channel to retain the curtain wall member in position comprises rotating the first curtain wall member until a latch at a second end of the horizontally-disposed latching arm of the latching member comes into latching engagement with a locking member disposed beneath a lower surface of the supporting member of the second curtain wall member supporting channel.

17. The method of claim 12, wherein the mounting plate of the first curtain wall member mounting apparatus comprises:

a first surface;

a second serrated surface opposite the first surface; and an aperture.

18. The method of claim 17, wherein the first curtain wall member mounting apparatus is coupled to the first end of the first curtain wall member by a lock washer, the lock washer comprising:

a first serrated surface and a second surface, the first serrated surface adapted to couple to the second serrated surface of the mounting plate of the first curtain wall member mounting apparatus;

an aperture; and a fastener adapted to couple the mounting plate of the first curtain wall member mounting apparatus to the first curtain wall member.

19. The method of claim 12, wherein:

the first channel of the first curtain wall member mounting apparatus is between a first projection and a second projection of the plurality of projections of the first curtain wall member mounting apparatus; and the second channel of the first curtain wall member mounting apparatus is between the second projection and a third projection of the plurality of projections of the first curtain wall member mounting apparatus.

20. The method of claim 12, wherein:

the first channel of the first curtain wall member mounting apparatus is between a first projection and a second projection of the plurality of projections of the first curtain wall member mounting apparatus; and the second channel of the first curtain wall member mounting apparatus is between a third projection and a fourth projection of the plurality of projections of the first curtain wall member mounting apparatus.

* * * * *